US006817044B1

(12) United States Patent
Ouyoung

(10) Patent No.: US 6,817,044 B1
(45) Date of Patent: Nov. 16, 2004

(54) BATHROOM ACCESSORIES HOLDER

(75) Inventor: Scott Ouyoung, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 10/434,182

(22) Filed: May 9, 2003

(51) Int. Cl.[7] ..... A47K 3/024

(52) U.S. Cl. ..... 4/576.1; 4/559; 211/105.1; 248/251

(58) Field of Search ..... 4/559, 576.1; 211/105.1, 211/105.2; 248/251

(56) References Cited

U.S. PATENT DOCUMENTS 6,430,759 B1 * 8/2002 Beltran ..... 4/576.1

* cited by examiner

*Primary Examiner*—Charles E. Phillips
(74) *Attorney, Agent, or Firm*—Leong C. Lei

(57) ABSTRACT

An unproved structure of a bathroom accessories holder allowing fast installation and replacement is essentially comprised of a positioning disk, a bonnet and a central lever; the disk being secured into the wall, one end of the central lever being inserted into a square guide rod on the disk through a bushing and a bonnet; and the other end being provided with a ball penetrated by a screw with both ends of the screw respectively secured with a hook and a bulb to be connected to bathroom accessories.

1 Claim, 5 Drawing Sheets

BATHROOM ACCESSORIES HOLDER

BACKGROUND OF THE INVENTION (a) Field of the Invention

The present invention is related to a bathroom accessories holder, and more particularly, to a wall-mounting holder allowing fast installation, positioning, securing and replacement.

(b) Description of the Prior Art

As illustrated in FIG. 1 of the accompanying drawings, the prior art has a fixing disk 32 screwed into the wall to receive the bottom of a holder 30, leveled, then a check screw 31 is inserted into a screw hole usually bored in the lower part of the outer circumference at the bottom of the holder 30 to position and affix a bathroom accessories holder to the fixing disk 32. However, during its installation the prior art has been found to have the following flaws:

1. Complicated Installation. The bathroom accessories holder has to be installed upon the completion of the positioning and installation of the fixing disk 32, then a level rule is used to determine whether the bathroom accessories holder is in parallel with the fixing disk; meanwhile, one hand has to hold the holder 30 and the other hand must mount the check screw 31 into the fixing disk 32, and so any displacement of the hand will require the leveling to be done again.
2. Low Stability. The holder is vulnerable collapse. When the holder is secured, it lacks sufficient support other than the check screw, resulting in lateral displacement due to the momentum created by the weight of the object banging upon the holder or by external force applied.
3. Difficult Replacement. If replacement is required, the check screw 31 has to be first removed to repeat the installation process as described above, which is a complicated and less time efficient process.

SUMMARY OF THE INVENTION

The primary purpose of the present invention is to provide a bathroom accessories holder that permits easy and fast installation, replacement and positioning to save the time required for installation and to promote the utility of the bathroom accessories holder by accurate positioning and easy replacement.

The foregoing object and summary provide only a brief introduction to the present invention. To fully appreciate these and other objects of the present invention as well as the invention itself, all of which will become apparent to those skilled in the art the following detailed description of the invention and the claims should be read in conjunction with the accompanying drawings. Throughout the specification and drawings identical reference numerals refer to identical or solar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
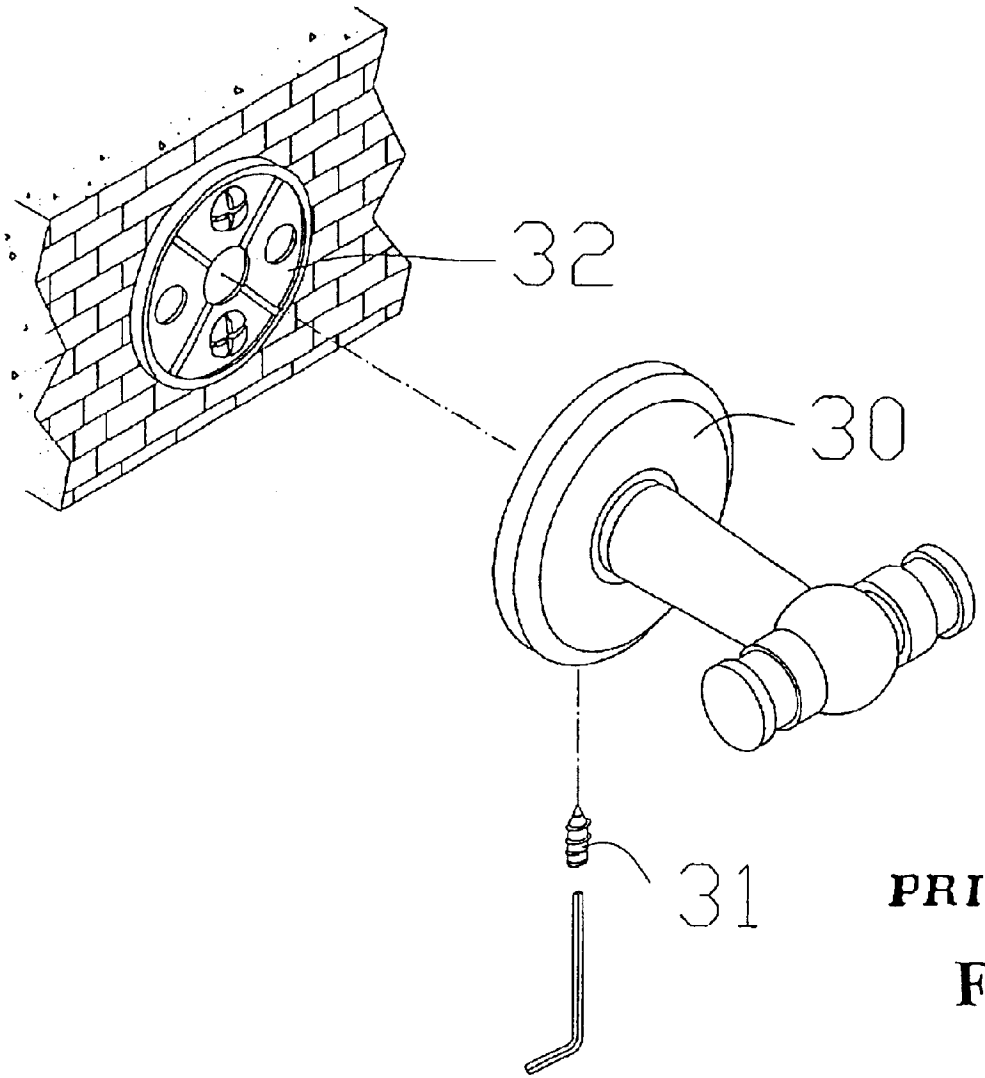
PRIOR ART FIG. 1
FIG. 1 is a schematic view of an assembly of the prior art
Figure 2:
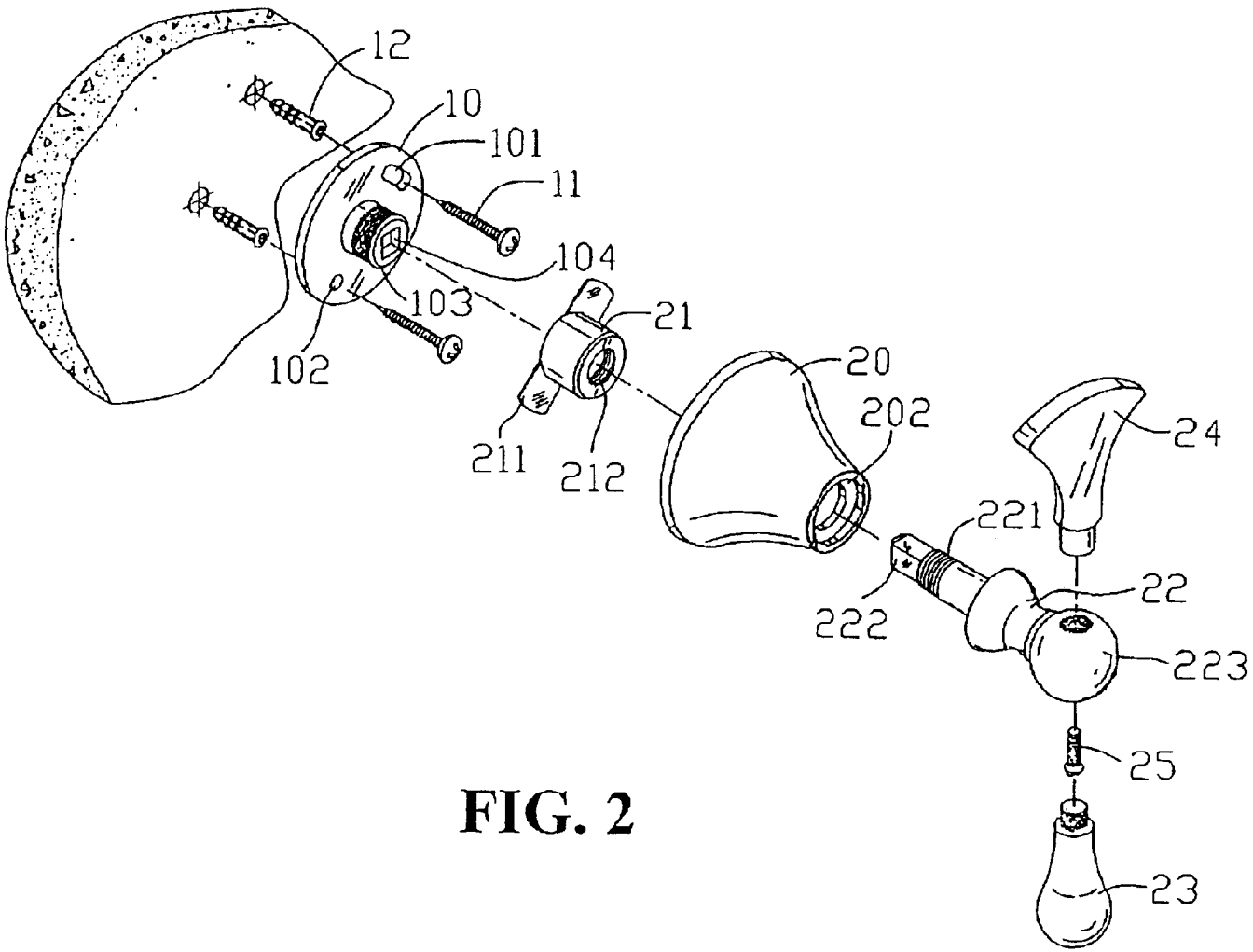
FIG. 2 is an exploded view of an assembly of a preferred embodiment of the present invention.
Figure 3:
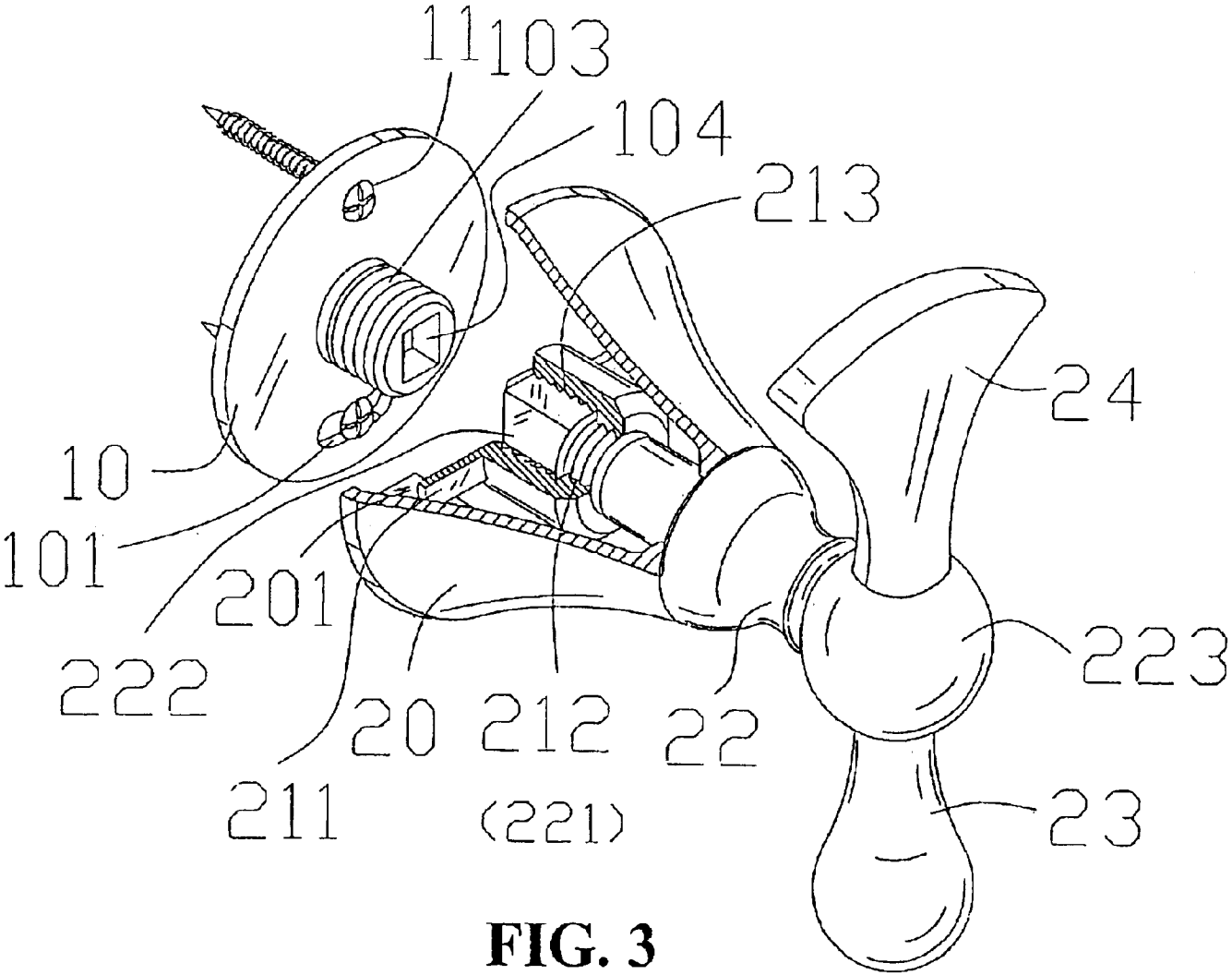
FIG. 3 is a sectional view of the preferred embodiment of the present invention.
Figure 4B:
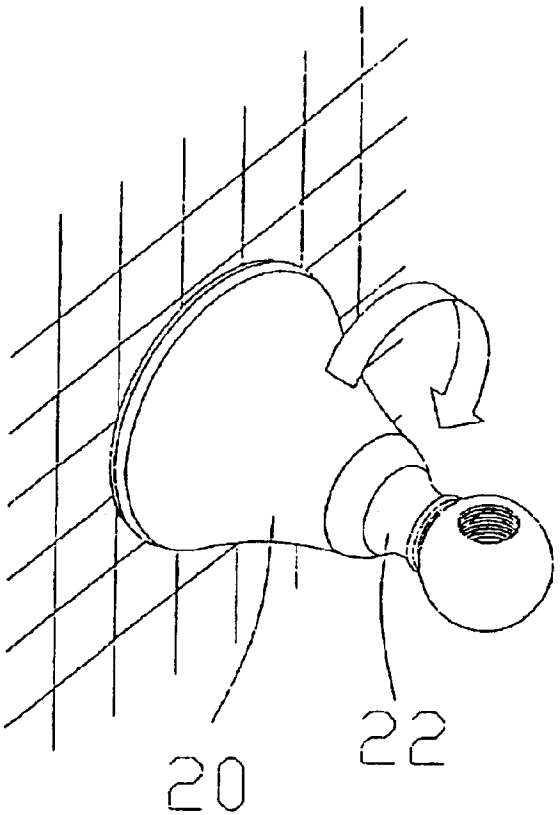
FIGS. 4A and 4B are schematic views showing the installation process of the preferred embodiment of the present invention.
Figure 4A:
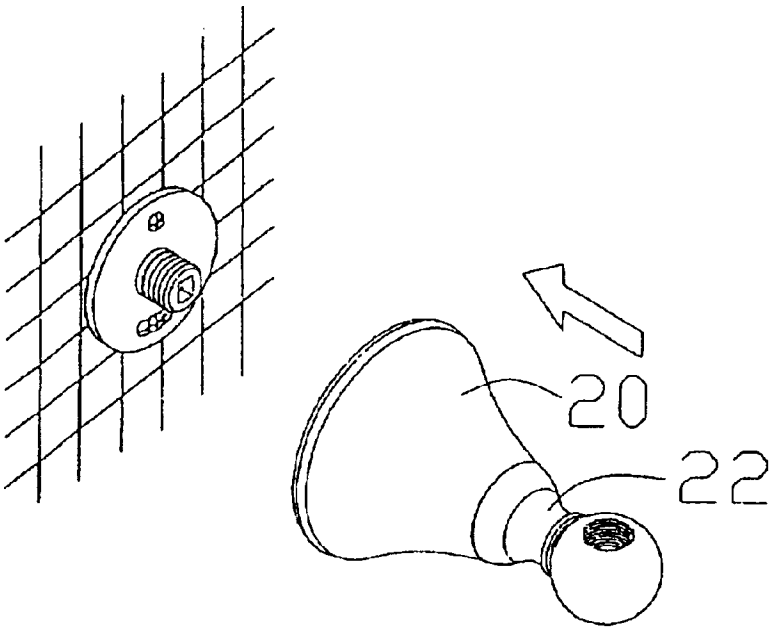
Figure 5A:
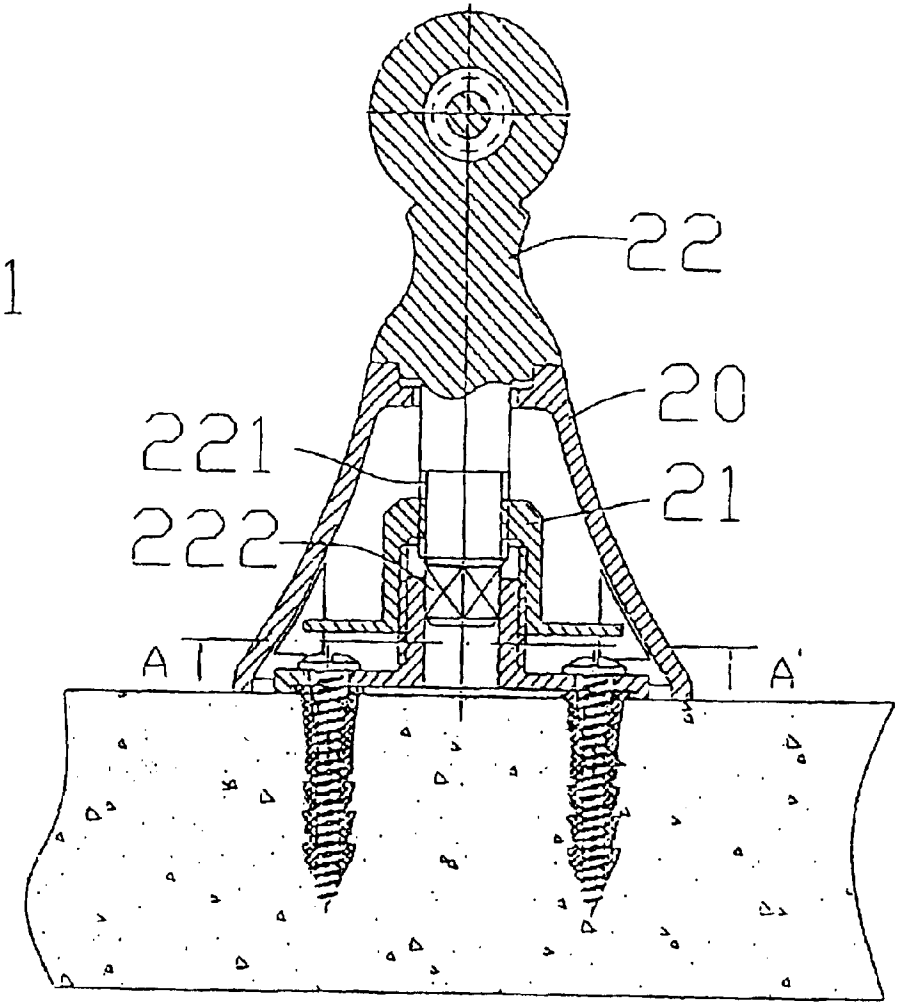
FIGS. 5A and 5B are sectional views of the assembly of the preferred embodiment of the present invention.
Figure 5B:
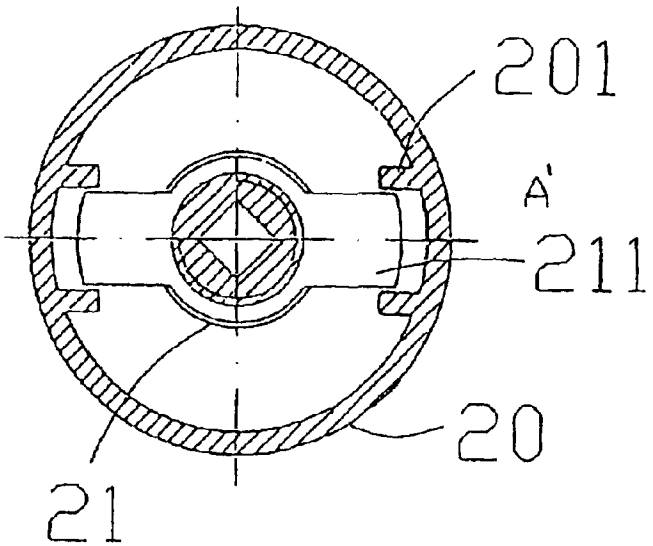

Referring to FIGS. 2 and 3, the present invention is essentially comprised of a convex positioning disk 10 to be locked into the wall as the primary support. A threaded guide rod 103 is protruded from the center on the other side in relation to the side adhered to the wall of the holder 10, a male thread is provided on the outer circumference at the top of the rod 103, a recessed square guide way 104 extending inwards is provided at the center at the top of the rod 103. A check hole 101 and a fixing hole 102 are provided on the rose at the bottom of the rod 103. A bonnet 20 relates to a cover for the rod 103, and also as the essential appearance of the bathroom accessories. The bonnet 20 is designed as a round cover with recessed are in the preferred embodiment of the present invention. Four limiting tags 201 in parallel to one another are provided in the direction parallel to that of an opening at the top to the bottom of the bonnet 20. A slide way is defined in between any two abutted limiting tags 201 and a limiting ring 202 internally graded is provided at the opening of the top of the bonnet 20.

A lever 22 connects the bonnet 20 and a member to be supported by the top of the lever 22. The lever 22 is made in a round shape in the preferred embodiment and graded at its base in relation towards the direction of the top of the bonnet and in a style continued from that of the outer circumference of the bonnet 20. A circular rod is protruded from the center of the base of lever 22. The middle of the circular rod relates to a threaded section 221 to be engaged to a pivoting thread 212 provided on a positioning bushing 21. A guide lever 222 is protruded from the outer end of the pivoting thread 212 to be inserted into the guide way 104 in the positioning disk 10. A ball end 223 is provided at the front of the lever 22 and a screw hole penetrates through both sides of the ball end 223 to receive the insertion of a screw 25 to engage a hook 24 provided at the opening of the other end of the ball end 223, and the screw is then locked up with a bulb 23.

Upon assembling, a check screw 11 is inserted into an expansion screw 12 in the wall to secure the positioning disk 10, the play defined by the arc opening of the positioning hole 101 is used to execute vertical adjustment such that the square hole of the guide way 104 is horizontally positioned. One end of the lever 22 is inserted into the opening of the limiting ring 202 provided at the top of the bonnet for two positioning wings 211 on both sides of the bushing 21 are inserted into the slide way defined between those limiting tags 201 provided on the inner wall of the bonnet 20 with the pivoting thread 212 at the top of the bushing 21 which interlocks with the external thread 221 provided on the lever 22.

Now referring to FIGS. 4A, 4B, 5A and 5B, with one hand holding the external circumference of the bonnet 20, the guide lever 222 at one end of the lever 22 at the center is aligned to the guide hole 104 at the center of the positioning disk 10 and inserted into the positioning disk 10; since the hook 24 is parallel to a line at the right angle to the guide lever 222, once the guide lever 222 is inserted into and leveled in the positioning disk 10, the guide lever 222 has to be either parallel to or at a right angle to the hook 24. Simply by rotating the outer circumference of the bonnet 20, those positioning wings 211 on both sides of the bushing 21 linked to the limiting plate 201 inside the bonnet are driven to rotate the pivoting thread 212 at the center of the bushing 21. Meanwhile, the external thread 221 engaged to the pivoting thread 212 is prevented from being turned due to that the guide lever 222, which is extended from one end of the external thread 221, being restricted by the square guide way 104. Consequently, the external thread 221U, the lever 22 at the rear end of the external thread 221 drives the top of the bonnet to press toward the positioning disk 10 to complete the assembly.

The present invention provides the following advantages:

1. Fast assembly and replacement. Once the positioning disk is secured in the wall, the subsequent installation is completed strictly by hand without any hand tool to significantly improve the operation or replacement efficiency, a practical help for a DIY operator and for future maintenance and replacement works.
2. Well secured. When in use the bathroom accessories directly bear the torque and central gravity applied on the wall. The present invention, which has the lever directly connected to the positioning disk, not only increases the ability of the bonnet to resist the compression applied by the central gravity, but also prevents the torque or rotation from an object on the bathroom accessories holder directly displacing the lever since the lever is prevented from independently rotating on the positioning disk. It only takes the turning of the outer circumference of the positioning disk to turn the lever. Therefore, the prevent invention allows better securing performance than any of the prior art.

Furthermore, the present invention permits easy and fast installation and significantly improved stability to upgrade its utility in meeting the innovation and advanced requirements of a utility patent. Therefore, this application for a utility patent is duly filed.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a bathroom accessories holder comprising:

a positioning disk having a threaded guide rod at a center of the disk, a recessed guide way at a center of a top of the rod, a positioning adjustment hole and a fixing hole on the disk;

a bonnet in the form of a hollow cover for the positioning disk containing four limiting tags in two units parallel to each other, a slide way being defined between each unit of the limiting tags, and a limiting ring provided with internal graduation located at the top of the bonnet; and a lever, including a graded bottom, in style continued from that of an external circumference of the bonnet, a circular rod protruding at a center of the bottom, a middle of the lever being externally threaded to be engaged to threads provided on the rod at the center of the disk, a guide lever being extended from an outer end of the circular rod to be inserted into the guide way in the disk, a front end of the lever assuming the shape of a ball end, a screw hole penetrating both sides of the ball end, a screw being inserted through the screw hole to be engaged to a hook and a bulb;

wherein one end of the lever is inserted through an opening of the limiting ring provided at a top of the bonnet, two positioning wings one on each side of said positioning bushing being inserted into a respective slide way formed between two limiting tags on an inner wall of the bonnet, the threads of the threaded guide rod being interlocked with external threads on the lever, one end of the lever being inserted into the guide way of the disk and the disk being rotated to secure the lever.

* * * * *